US006802369B2

(12) United States Patent
Zentner et al.

(10) Patent No.: US 6,802,369 B2
(45) Date of Patent: Oct. 12, 2004

(54) REFRIGERATOR QUICK CHILL AND THAW CONTROL METHODS AND APPARATUS

(75) Inventors: Martin M. Zentner, Prospect, KY (US); Wolfgang Daum, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/754,593

(22) Filed: Jan. 5, 2001

(65) Prior Publication Data

US 2003/0029178 A1 Feb. 13, 2003

(51) Int. Cl.[7] ..... F28F 13/00; F25D 17/04

(52) U.S. Cl. ..... 165/267; 165/247; 165/244; 62/132; 62/156; 62/408

(58) Field of Search ..... 165/200, 267, 165/201, 243, 244, 247, 253, 254, 268, 265, 61; 62/125, 126, 129, 132, 151, 156, 157, 158, 159, 404, 405, 407, 408, 234

(56) References Cited

U.S. PATENT DOCUMENTS

| | | | | |
|---|---|---|---|---|
| 4,002,199 | A | 1/1977 | Jacobs | |
| 4,555,057 | A | 11/1985 | Foster | |
| 4,841,735 | A | 6/1989 | Oike | |
| 5,136,865 | A | 8/1992 | Aoki et al. | |
| 5,326,578 | A | 7/1994 | Yun | |
| 5,476,672 | A | 12/1995 | Kim | |
| 5,896,753 | A | 4/1999 | Kwak et al. | |
| 5,930,454 | A | 7/1999 | Cho | |
| 2002/0116943 | A1 * | 8/2002 | Tupis et al. | 62/407 |
| 2003/0140639 | A1 * | 7/2003 | Gray et al. | 62/157 |

FOREIGN PATENT DOCUMENTS

| | | |
|---|---|---|
| EP | 1 221 577 A1 * | 7/2002 |
| JP | 03267672 | 11/1991 |
| JP | 04244569 | 9/1992 |
| JP | 05187756 | 7/1993 |
| JP | 06011231 | 1/1994 |

* cited by examiner

*Primary Examiner*—Ljiljana Ciric
(74) *Attorney, Agent, or Firm*—H. Nell Houser, Esq.; Armstrong Teasdale LLP

(57) ABSTRACT

A control system for a refrigerator quick chill and thaw system comprises an electronic controller coupled to the operable components of a modular air handler for producing a convective airstream in a sealed pan for rapid chilling and safe thawing. The controller is configured to operate the air handler to execute a chill mode when selected by a user, operate the air handler to execute a thaw mode when selected by a user, adjust the air handler components for the selected chill mode or thaw mode, and maintain a constant temperature airstream in the pan to execute the selected chill mode or the thaw mode. Adaptive chill and thaw algorithms are executable by the controller in response to user input and temperature conditions inside the sealed pan.

24 Claims, 16 Drawing Sheets

FIG. 9B →

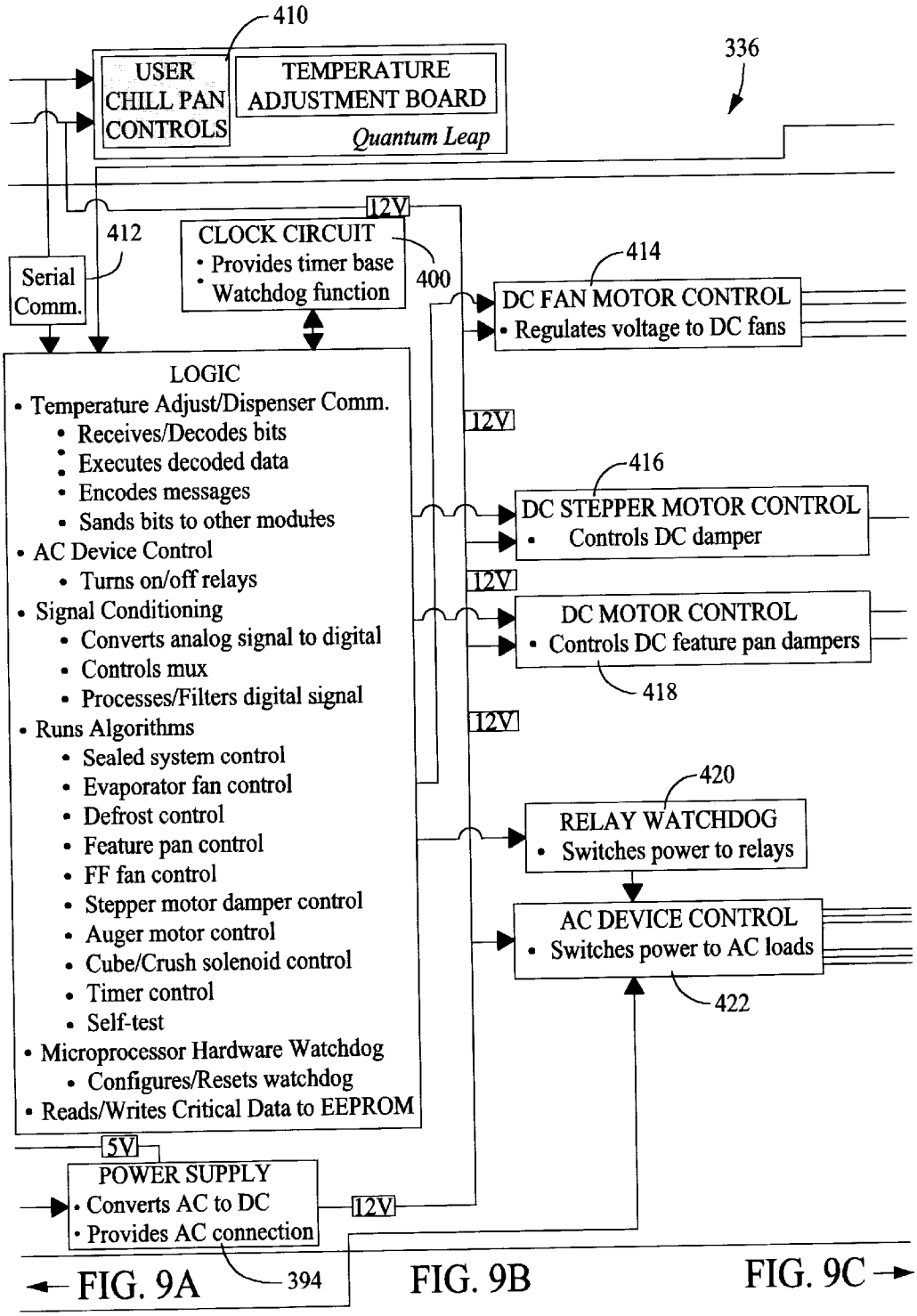
410
USER CHILL PAN CONTROLS
TEMPERATURE ADJUSTMENT BOARD
Quantum Leap
336
12V
412
CLOCK CIRCUIT
• Provides timer base
• Watchdog function
400
Serial Comm.
414
DC FAN MOTOR CONTROL
• Regulates voltage to DC fans
LOGIC
• Temperature Adjust/Dispenser Comm.
• Receives/Decodes bits
• Executes decoded data
• Encodes messages
• Sands bits to other modules
• AC Device Control
• Turns on/off relays
• Signal Conditioning
• Converts analog signal to digital
• Controls mux
• Processes/Filters digital signal
• Runs Algorithms
• Sealed system control
• Evaporator fan control
• Defrost control
• Feature pan control
• FF fan control
• Stepper motor damper control
• Auger motor control
• Cube/Crush solenoid control
• Timer control
• Self-test
• Microprocessor Hardware Watchdog
• Configures/Resets watchdog
• Reads/Writes Critical Data to EEPROM
12V
416
DC STEPPER MOTOR CONTROL
• Controls DC damper
12V
DC MOTOR CONTROL
• Controls DC feature pan dampers
418
12V
420
RELAY WATCHDOG
• Switches power to relays
AC DEVICE CONTROL
• Switches power to AC loads
422
5V
POWER SUPPLY
• Converts AC to DC
• Provides AC connection
12V
394
FIG. 9A
FIG. 9B
FIG. 9C

← FIG. 9B

REFRIGERATOR QUICK CHILL AND THAW CONTROL METHODS AND APPARATUS

BACKGROUND OF THE INVENTION

This invention relates generally to refrigerators, and more particularly, to control systems for refrigerator quick chill and thaw systems.

A typical household refrigerator includes a freezer storage compartment and a fresh food storage compartment either arranged side-by-side and separated by a center mullion wall or over-and-under and separated by a horizontal center mullion wall. Shelves and drawers typically are provided in the fresh food compartment, and shelves and wire baskets typically are provided in the freezer compartment. In addition, an ice maker may be provided in the freezer compartment. A freezer door and a fresh food door close the access openings to the freezer and fresh food compartments, respectively.

Known refrigerators typically require extended periods of time to cool food and beverages placed therein. For example, it typically takes about 4 hours to cool a six pack of soda to a refreshing temperature of about 45° F. or less. Beverages, such as soda, are often desired to be chilled in much less time than several hours. Thus, occasionally these items are placed in a freezer compartment for rapid cooling. If not closely monitored, the items will freeze and possibly break the packaging enclosing the item and creating a mess in the freezer compartment.

Numerous quick chill and super cool compartments located in refrigerator fresh food storage compartments and freezer compartments have been proposed to more rapidly chill and/or maintain food and beverage items at desired controlled temperatures for long term storage. See, for example, U.S. Pat. Nos. 3,747,361, 4,358,932, 4,368,622, and 4,732,009. These compartments, however, undesirably reduce refrigerator compartment space, are difficult to clean and service, and have not proven capable of efficiently chilling foods and beverages in a desirable time frame, such, as for example, one half hour or less to chill a six pack of soda to a refreshing temperature. Furthermore, food or beverage items placed in chill compartments located in the freezer compartment are susceptible to undesirable freezing if not promptly removed by the user.

Attempts have also been made to provide thawing compartments located in a refrigerator fresh food storage compartment to thaw frozen foods. See, for example, U.S. Pat. No. 4,385,075. However, known thawing compartments also undesirably reduce refrigerator compartment space and are vulnerable to spoilage of food due to excessive temperatures in the compartments.

Accordingly, it would further be desirable to provide a quick chill and thawing system for use in a fresh food storage compartment that rapidly chills food and beverage items without freezing them, that timely thaws frozen items within the refrigeration compartment at controlled temperature levels to avoid spoilage of food, and that occupies a reduced amount of space in the refrigerator compartment.

BRIEF SUMMARY OF THE INVENTION

In an exemplary embodiment, a control system is provided for a refrigerator including a quick chill and thaw system. The quick chill and thaw system includes a modular air handler for producing convective airflow within a slide-out sealed pan at temperatures above and below a temperature of the fresh food compartment to achieve both rapid chilling and safe thawing of items in the pan.

More specifically, the air handler includes a first damper element adapted for flow communication with a supply of air, such as a refrigerator freezer compartment through an opening in a center mullion wall of the refrigerator so that a supply airflow path of the air handler is in flow communication with the first damper element. A fan in the air supply path discharges air from the air supply path into the pan, and a re-circulation airflow path allows mixing of air from the pan with freezer air in the supply airflow path for quick chilling. A heater element is located in an air handler return duct for warming air in the air handler for thawing. A temperature sensor is located in flow communication with at least one of the re-circulation flow path and the return flow path for temperature responsive operation of the quick chill and thaw system.

The control system for the quick chill and thaw system comprises an electronic controller coupled to the operable components of the air handler. The controller is configured to adjust the air handler components to produce a constant temperature airstream in the sealed pan, maintain a first constant temperature airstream in the pan to execute a chill mode when selected by a user, and maintain a second constant temperature airstream in the pan to execute a chill mode when selected by a user.

A chill algorithm is executable by the controller to maintain desired temperatures in the sealed pan, and the controller is responsive to temperature feedback from temperature sensors located in the air handler and re-adjusts operation of the air handler as necessary. Thaw algorithms are also executable by the controller and in one aspect, a heat output of the heater is monitored to sense a state of a frozen package to be thawed, and the controller determines an end of a thaw cycle by comparing the monitored heat output to a reference heat output.

An adaptive electronic control scheme is therefore provided to efficiently chill and safely thaw food and beverage items in a space saving quick chill and thaw system.

DETAILED DESCRIPTION OF THE INVENTION

Figure 1:
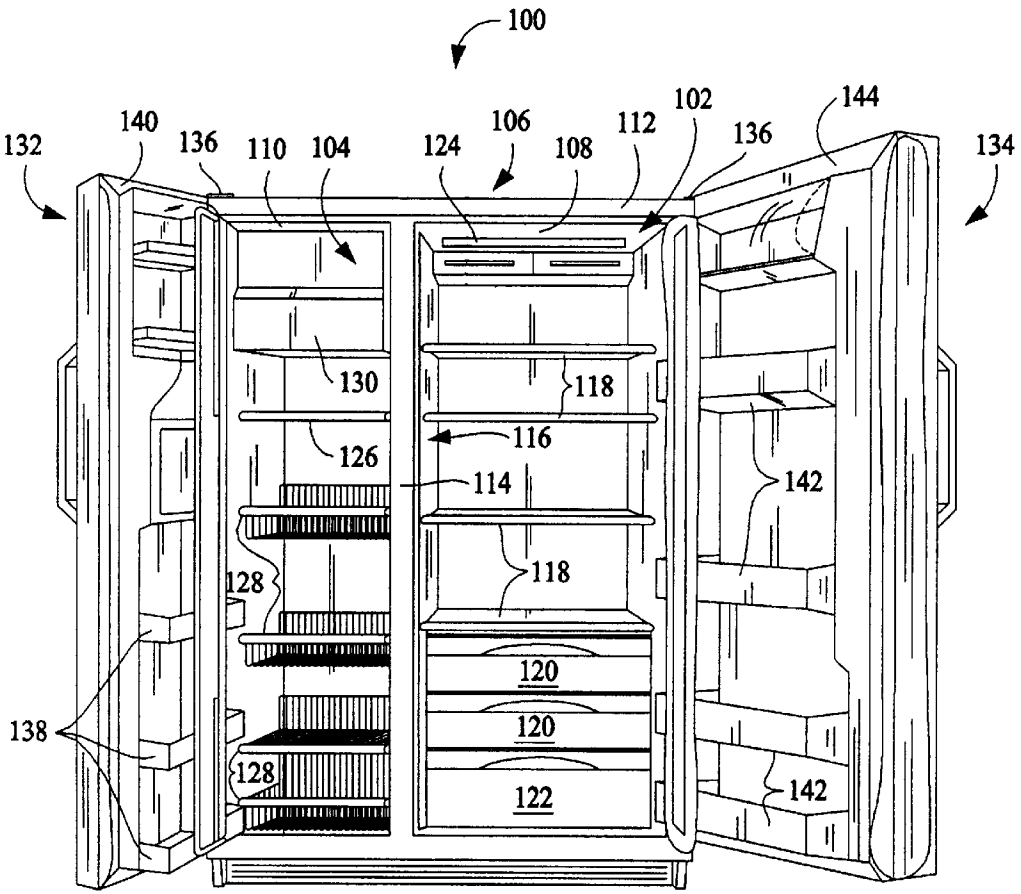
FIG. 1 is a perspective view of a refrigerator including a quick chill and thaw system.

FIG. 1 illustrates an exemplary side-by-side refrigerator 100 in which the present invention may be practiced. It is recognized, however, that the benefits of the present invention may be achieved in other types of refrigerators. Consequently, the description set forth herein is for illustrative purposes only and is not intended to limit the invention in any aspect.

Refrigerator 100 includes a fresh food storage compartment 102 and freezer storage compartment 104. Freezer compartment 104 and fresh food compartment 102 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case 106. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown in FIG. 1) described in detail below and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
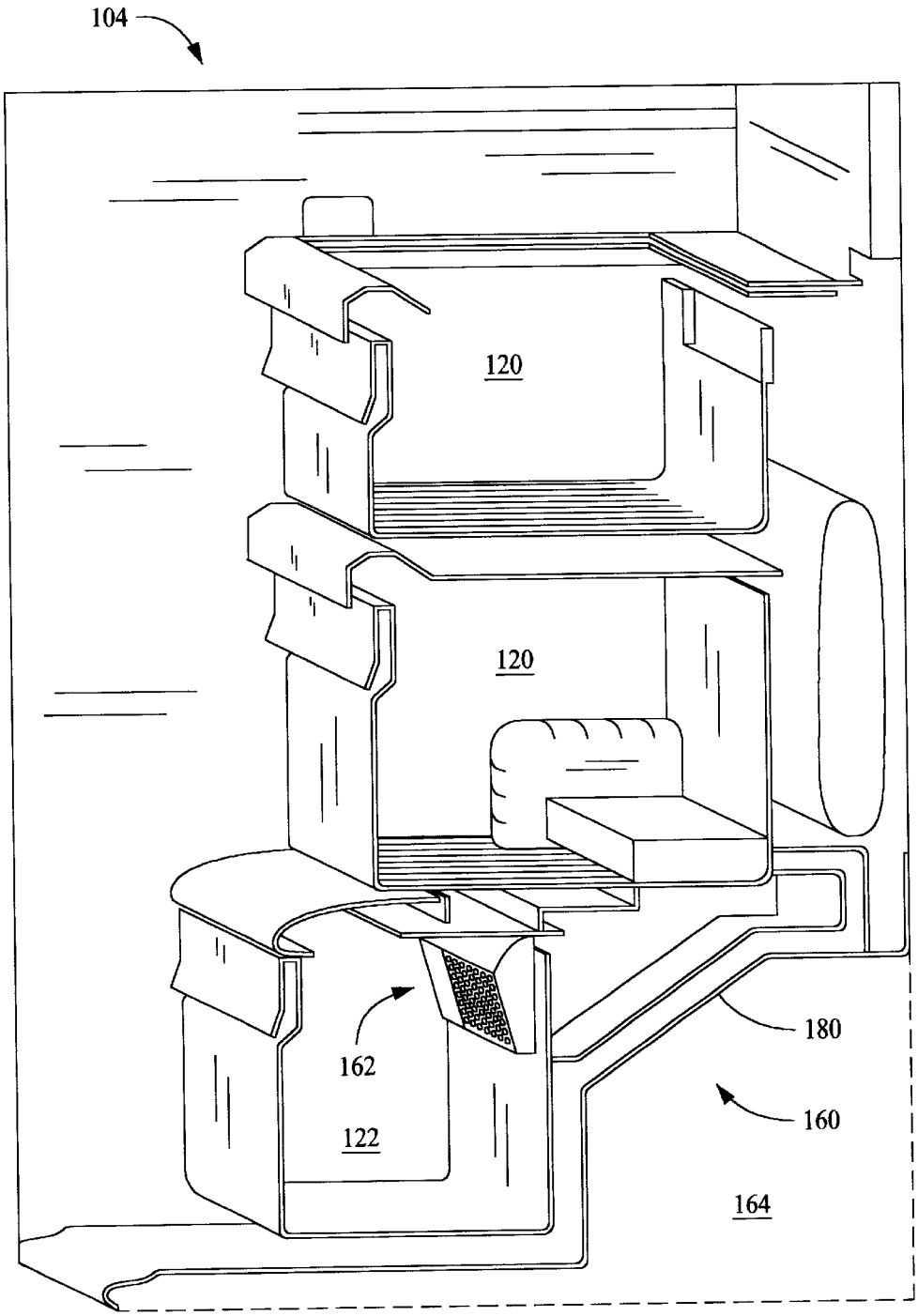
FIG. 2 is a partial perspective cut away view of a portion of FIG. 1 illustrating the quick chill and thaw system.

FIG. 2 is a partial cutaway view of fresh food compartment 102 illustrating storage drawers 120 stacked upon one another and positioned above a quick chill and thaw system 160. Quick chill and thaw system 160 includes an air handler 162 and sealed pan 122 located adjacent a pentagonal-shaped machinery compartment 164 (shown in phantom in FIG. 2) to minimize fresh food compartment space utilized by quick chill and thaw system 160. Storage drawers 120 are conventional slide-out drawers without internal temperature control. A temperature of storage drawers 120 is therefore substantially equal to an operating temperature of fresh food compartment 102. Quick chill and thaw pan 122 is positioned slightly forward of storage drawers 120 to accommodate machinery compartment 164, and air handler 162 selectively controls a temperature of air in pan 122 and circulates air within pan 122 to increase heat transfer to and from pan contents for timely thawing and rapid chilling, respectively, as described in detail below. When quick thaw and chill system 160 is inactivated, sealed pan 122 reaches a steady state at a temperature equal to the temperature of fresh food compartment 102, and pan 122 functions as a third storage drawer. In alternative embodiments, greater or fewer numbers of storage drawers 120 and quick chill and thaw systems 160, and other relative sizes of quick chill pans 122 and storage drawers 120 are employed.

In accordance with known refrigerators, machinery compartment 164 at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments.

Figure 3:
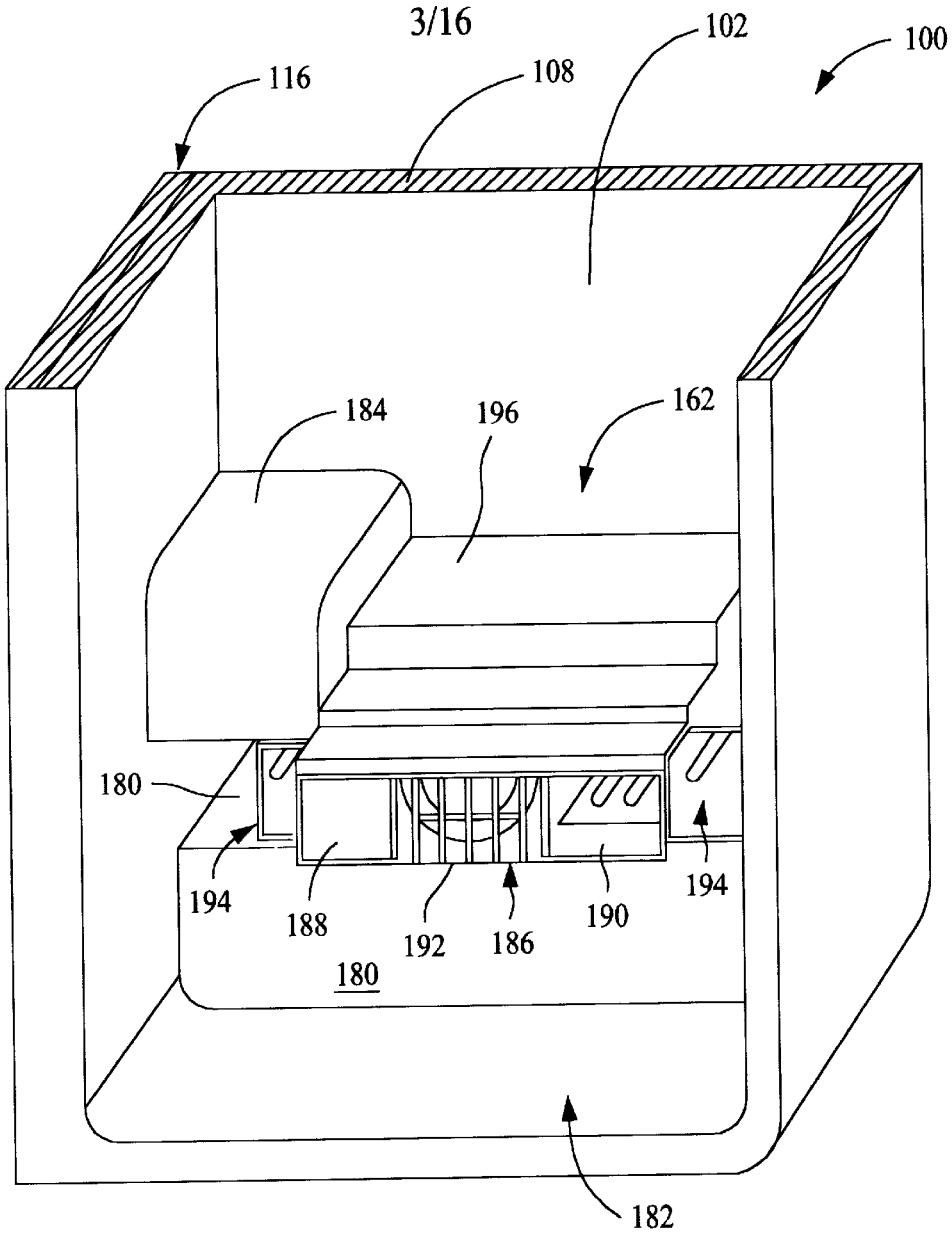
FIG. 3 is a partial perspective view of the quick chill and thaw system shown in FIG. 2 and illustrating an air handler mounted therein.

FIG. 3 is a partial perspective view of a portion of refrigerator 100 including air handler 162 mounted to fresh food compartment liner 108 above outside walls 180 of machinery compartment 164 (shown in FIG. 2) in a bottom portion 182 of fresh food compartment 102. Cold air is received from and returned to a freezer compartment bottom portion (not shown in FIG. 3) through an opening (not shown) in mullion center wall 116 and through supply and return ducts (not shown in FIG. 3) within supply duct cover 184. The supply and return ducts within supply duct cover 184 are in flow communication with an air handler supply duct 186, a re-circulation duct 188 and a return duct 190 on either side of air handler supply duct 186 for producing forced air convection flow throughout fresh food compartment bottom portion 182 where quick chill and thaw pan 122 (shown in FIGS. 1 and 2) is located. Supply duct 186 is positioned for air discharge into pan 122 at a downward angle from above and behind pan 122 (see FIG. 2), and a vane 192 is positioned in air handler supply duct 186 for directing and distributing air evenly within quick chill and thaw pan 122. Light fixtures 194 are located on either side of air handler 162 for illuminating quick chill and thaw pan 122, and an air handler cover 196 protects internal components of air handler 162 and completes air flow paths through ducts 186, 188, and 190. In alternative embodiment, one or more integral light sources are formed into one or more of air handler ducts 186, 188, 190 in lieu of externally mounted light fixtures 194.

In an alternative embodiment, air handler 162 is adapted to discharge air at other locations in pan 122, so as, for example, to discharge air at an upward angle from below and behind quick chill and thaw pan 122, or from the center or sides of pan 122. In another embodiment, air handler 162 is directed toward a quick chill pan 122 located elsewhere than a bottom portion 182 of fresh food compartment 102, and thus converts, for example, a middle storage drawer into a quick chill and thaw compartment. Air handler 162 is substantially horizontally mounted in fresh food compartment 102, although in alternative embodiments, air handler 162 is substantially vertically mounted. In yet another alternative embodiment, more than one air handler 162 is utilized to chill the same or different quick chill and thaw pans 122 inside fresh food compartment 102. In still another alternative embodiment, air handler 162 is used in freezer compartment 104 (shown in FIG. 1) and circulates fresh food compartment air into a quick chill and thaw pan to keep contents in the pan from freezing.

Figure 4:
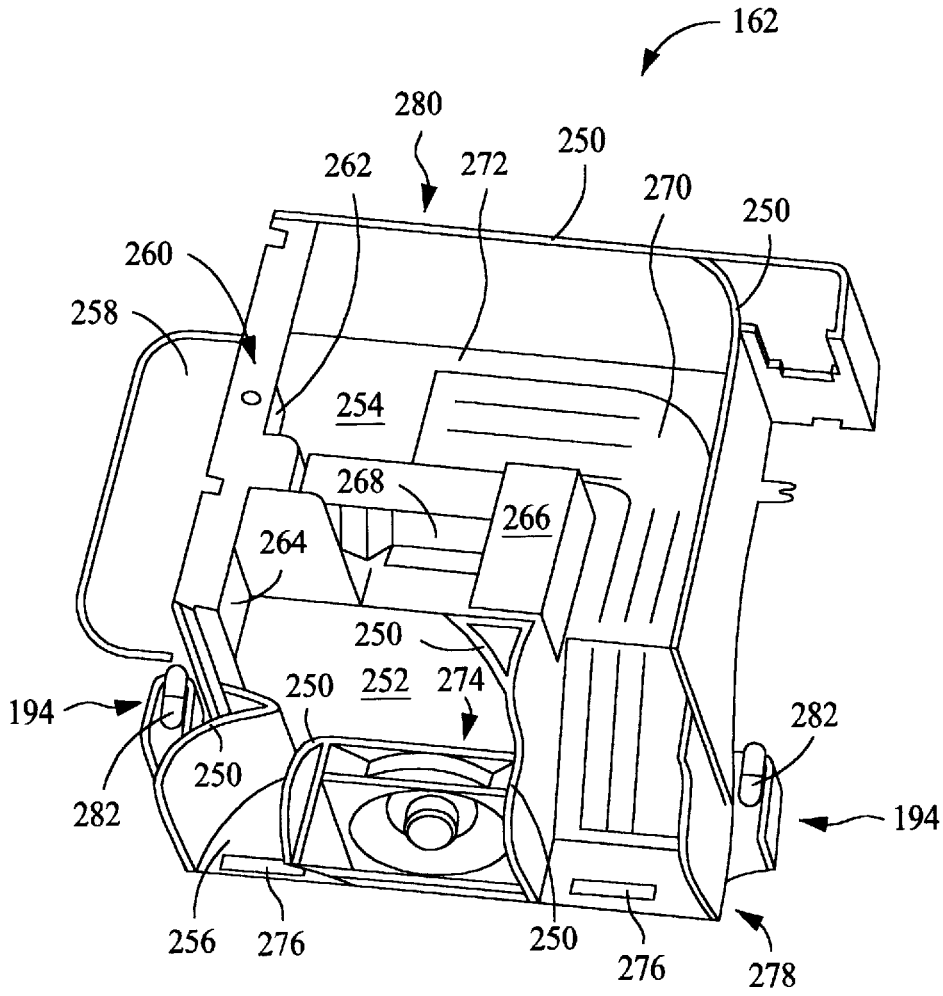
FIG. 4 is a partial perspective view of the air handler shown in FIG. 3.

FIG. 4 is a top perspective view of air handler 162 with air handler cover 196 (shown in FIG. 3) removed. A plurality of straight and curved partitions 250 define an air supply flow path 252, a return flow path 254, and a re-circulation flow path 256. A duct cavity member base 258 is situated adjacent a conventional dual damper element 260 for opening and closing access to return path 254 and supply path 252 through respective return and supply airflow ports 262, 264 respectively. A conventional single damper element 266 opens and closes access between return path 254 and supply path 252 through an airflow port 268, thereby selectively converting return path 254 to an additional re-circulation path as desired for air handler thaw and/or quick chill modes. A heater element 270 is attached to a bottom surface 272 of re-circulation path 256 for warming air in a quick thaw mode, and a fan 274 is provided in supply path 252 for drawing air from supply path 252 and forcing air into quick chill and thaw pan 122 (shown in FIG. 2) at a specified volumetric flow rate through vane 192 (shown in FIG. 3) located downstream from fan 274 for dispersing air entering quick chill and thaw pan 122. Temperature sensors 276 are located in flow communication with re-circulation path 256 and/or return path 254 and are operatively coupled to a microprocessor (not shown in FIG. 8) which is, in turn, operatively coupled to damper elements 260, 266, fan 274, and heater element 270 for temperature-responsive operation of air handler 162.

A forward portion 278 of air handler 162 is sloped downwardly from a substantially flat rear portion 280 to accommodate sloped outer wall 180 of machinery compartment 164 (shown in FIG. 2) and to discharge air into quick chill and thaw pan 122 at a slight downward angle. In one embodiment, light fixtures 194 and light sources 282, such as conventional light bulbs are located on opposite sides of air handler 162 for illuminating quick chill and thaw pan 122. In alternative embodiments, one or more light sources are located internal to air handler 162.

Air handler 162 is modular in construction, and once air handler cover 196 is removed, single damper element 266, dual damper element 260, fan 274, vane 192 (shown in FIG. 3), heater element 270 and light fixtures 194 are readily accessible for service and repair. Malfunctioning components may simply be pulled from air handler 162 and quickly replaced with functioning ones. In addition, the entire air handler unit may be removed from fresh food compartment 102 (shown in FIG. 2) and replaced with another unit with the same or different performance characteristics. In this aspect of the invention, an air handler 162 could be inserted into an existing refrigerator as a kit to convert an existing storage drawer or compartment to a quick chill and thaw system.

Figure 5:
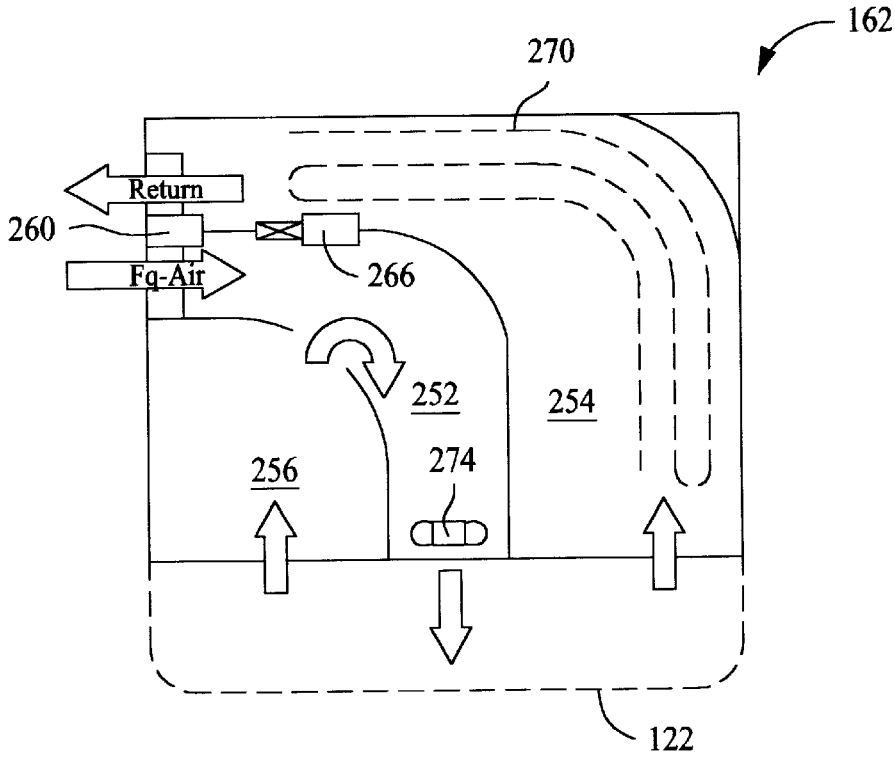
FIG. 5 is a functional schematic of the air handler shown in FIG. 4 in a quick chill mode.

FIG. 5 is a functional schematic of air handler 162 in a quick chill mode. Dual damper element 260 is open, allowing cold air from freezer compartment 104 (shown in FIG. 1) to be drawn through an opening (not shown) in mullion center wall 116 (shown in FIGS. 1 and 3) and to air handler air supply flow path 252 by fan 274. Fan 274 discharges air from air supply flow path 252 to pan 122 (shown in phantom in FIG. 5) through vane 192 (shown in FIG. 3) for circulation therein. A portion of circulating air in pan 122 returns to air handler 162 via re-circulation flow path 256 and mixes with freezer air in air supply flow path 252 where it is again drawn through air supply flow path 252 into pan 122 via fan 274. Another portion of air circulating in pan 122 enters return flow path 254 and flows back into freezer compartment 104 through open dual damper element 260. Single damper element 266 is closed, thereby preventing airflow from return flow path 254 to supply flow path 252, and heater element 270 is de-energized.

In one embodiment, dampers 260 and 266 are selectively operated in a fully opened and fully closed position. In alternative embodiments, dampers 260 and 266 are controlled to partially open and close at intermediate positions between the respective fully open position and the fully closed position for finer adjustment of airflow conditions within pan 122 by increasing or decreasing amounts of freezer air and re-circulated air, respectively, in air handler supply flow path 252. Thus, air handler 162 may be operated in different modes, such as, for example, an energy saving mode, customized chill modes for specific food and beverage items, or a leftover cooling cycle to quickly chill meal leftovers or items at warm temperatures above room temperature. For example, in a leftover chill cycle, air handler may operate for a selected time period with damper 260 fully closed and damper 266 fully open, and then gradually closing damper 266 to reduce re-circulated air and opening damper 266 to introduce freezer compartment air as the leftovers cool, thereby avoiding undesirable temperature effects in freezer compartment 104 (shown in FIG. 1). In a further embodiment, heater element 270 is also energized to mitigate extreme temperature gradients and associated effects in refrigerator 100 (shown in FIG. 1) during leftover cooling cycles and to cool leftovers at a controlled rate with selected combinations of heated air, unheated air, and freezer air circulation in pan 122.

It is recognized, however, that because restricting the opening of damper 266 to an intermediate position limits the supply of freezer air to air handler 162, the resultant higher air temperature in pan 122 reduces chilling efficacy.

Dual damper element airflow ports 262, 264 (shown in FIG. 4), single damper element airflow port 268 (shown in FIG. 4), and flow paths 252, 254, and 256 are sized and selected to achieve an optimal air temperature and convection coefficient within pan 122 with an acceptable pressure drop between freezer compartment 104 (shown in FIG. 1) and pan 122. In an exemplary implementation of the invention, fresh food compartment 102 temperature is maintained at about 37° F., and freezer compartment 104 is maintained at about 0° F. While an initial temperature and surface area of an item to be warmed or cooled affects a resultant chill or defrost time of the item, these parameters are incapable of control by quick chill and thaw system 160 (shown in FIG. 2). Rather, air temperature and convention coefficient are predominantly controlled parameters of quick chill and thaw system 160 to chill or warm a given item to a target temperature in a properly sealed pan 122.

In a specific embodiment of the invention, it was empirically determined that an average air temperature of 22° F. coupled with a convection coefficient of 6 BTU/hr.ft.$^{2}$° F. is sufficient to cool a six pack of soda to a target temperature of 45° or lower in less than about 45 minutes with 99% confidence, and with a mean cooling time of about 25 minutes. Because convection coefficient is related to volumetric flow rate of fan 274, a volumetric flow rate can be determined and a fan motor selected to achieve the determined volumetric flow rate. In a specific embodiment, a convection coefficient of about 6 BTU/hr.ft.$^{2}$° F. corresponds to a volumetric flow rate of about 45 ft$^3$/min. Because a pressure drop between freezer compartment 104 (shown in FIG. 1) and quick chill and thaw pan 122 affects fan output and motor performance, an allowable pressure drop is determined from a fan motor performance pressure drop versus volumetric flow rate curve. In a specific embodiment, a 92 mm, 4.5 W DC electric motor is employed, and to deliver about 45 ft$^3$/min of air with this particular motor, a pressure drop of less than 0.11 inches $H_2O$ is required.

Investigation of the required mullion center wall 116 opening size to establish adequate flow communication between freezer compartment 104 (shown in FIG. 1) and air handler 162 was plotted against a resultant pressure drop in pan 122. Study of the plot revealed that a pressure drop of 0.11 inches $H_2O$ or less is achieved with a mullion center wall opening having an area of about 12 in$^2$. To achieve an average air temperature of about 22° F. at this pressure drop, it was empirically determined that minimum chill times are achieved with a 50% mix of re-circulated air from pan 122 and freezer compartment 104 air. It was then determined that a required re-circulation path opening area of about 5 in$^2$ achieves a 50% freezer air/re-circulated air mixture in supply path at the determined pressure drop of 0.11 inches $H_2O$. A study of pressure drop versus a percentage of the previously determined mullion wall opening in flow communication with freezer compartment 104, or supply air, revealed that a mullion center wall opening area division of 40% supply and 60% return satisfies the stated performance parameters.

Thus, convective flow in pan 122 produced by air handler 162 is capable of rapidly chilling a six pack of soda more than four times faster than a typical refrigerator. Other items, such as 2 liter bottles of soda, wine bottles, and other beverage containers, as well as food packages, may similarly be rapidly cooled in quick chill and thaw pan 122 in significantly less time than required by known refrigerators.

Figure 6:
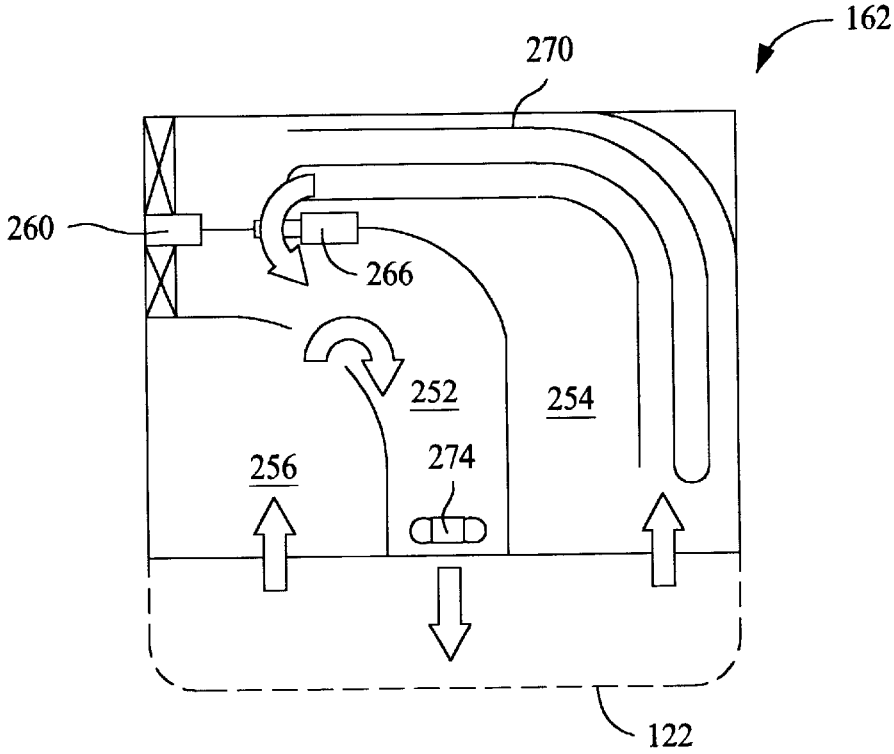
FIG. 6 is a functional schematic of the air handler shown in FIG. 4 in a quick thaw mode.

FIG. 6 is a functional schematic of air handler 162 shown in a thaw mode wherein dual damper element 260 is closed, heater element 270 is energized and single damper element 266 is open so that air flow in return path 254 is returned to supply path 252 and is drawn through supply path 252 into pan 122 by fan 274. Air also returns to supply path 252 from pan 122 via re-circulation path 256. Heater element 270, in one embodiment, is a foil-type heater element that is cycled on and off and controlled to achieve optimal temperatures for refrigerated thawing independent from a temperature of fresh food compartment 102. In other embodiments, other known heater elements are used in lieu of foil type heater element 270.

Heater element 270 is energized to heat air within air handler 162 to produce a controlled air temperature and velocity in pan 122 to defrost food and beverage items without exceeding a specified surface temperature of the item or items to be defrosted. That is, items are defrosted or thawed and held in a refrigerated state for storage until the item is retrieved for use. The user therefore need not monitor the thawing process at all.

In an exemplary embodiment, heater element 270 is energized to achieve an air temperature of about 40° to about 50°, and more specifically about 41° for a duration of a defrost cycle of selected length, such as, for example, a four hour cycle, an eight hour cycle, or a twelve hour cycle. In alternative embodiments, heater element 270 is used to cycle air temperature between two or more temperatures for the same or different time intervals for more rapid thawing while maintaining item surface temperature within acceptable limits. In further alternative embodiments, customized thaw modes are selectively executed for optimal thawing of specific food and beverage items placed in pan 122. In still further embodiments, heater element 270 is dynamically controlled in response to changing temperature conditions in pan 122 and air handler 162.

A combination rapid chilling and enhanced thawing air handler 162 is therefore provided that is capable of rapid chilling and defrosting in a single pan 122. Therefore, dual purpose air handler 162 and pan 122 provides a desirable combination of features while occupying a reduced amount of fresh food compartment space.

When air handler 162 is neither in quick chill mode nor thaw mode, it reverts to a steady state at a temperature equal to that of fresh food compartment 102. In a further embodiment, air handler 162 is utilized to maintain storage pan 122 at a selected temperature different from fresh food compartment 102. Dual damper element 260 and fan 274 are controlled to circulate freezer air to maintain pan 122 temperature below a temperature of fresh food compartment 102 as desired, and single damper element 266, heater element 270, and fan 274 are utilized to maintain pan 122 temperature above the temperature of fresh food compartment 102 as desired Thus, quick chill and thaw pan 122 may be used as a long term storage compartment maintained at an approximately steady state despite fluctuation of temperature in fresh food compartment 102.

Figure 7:
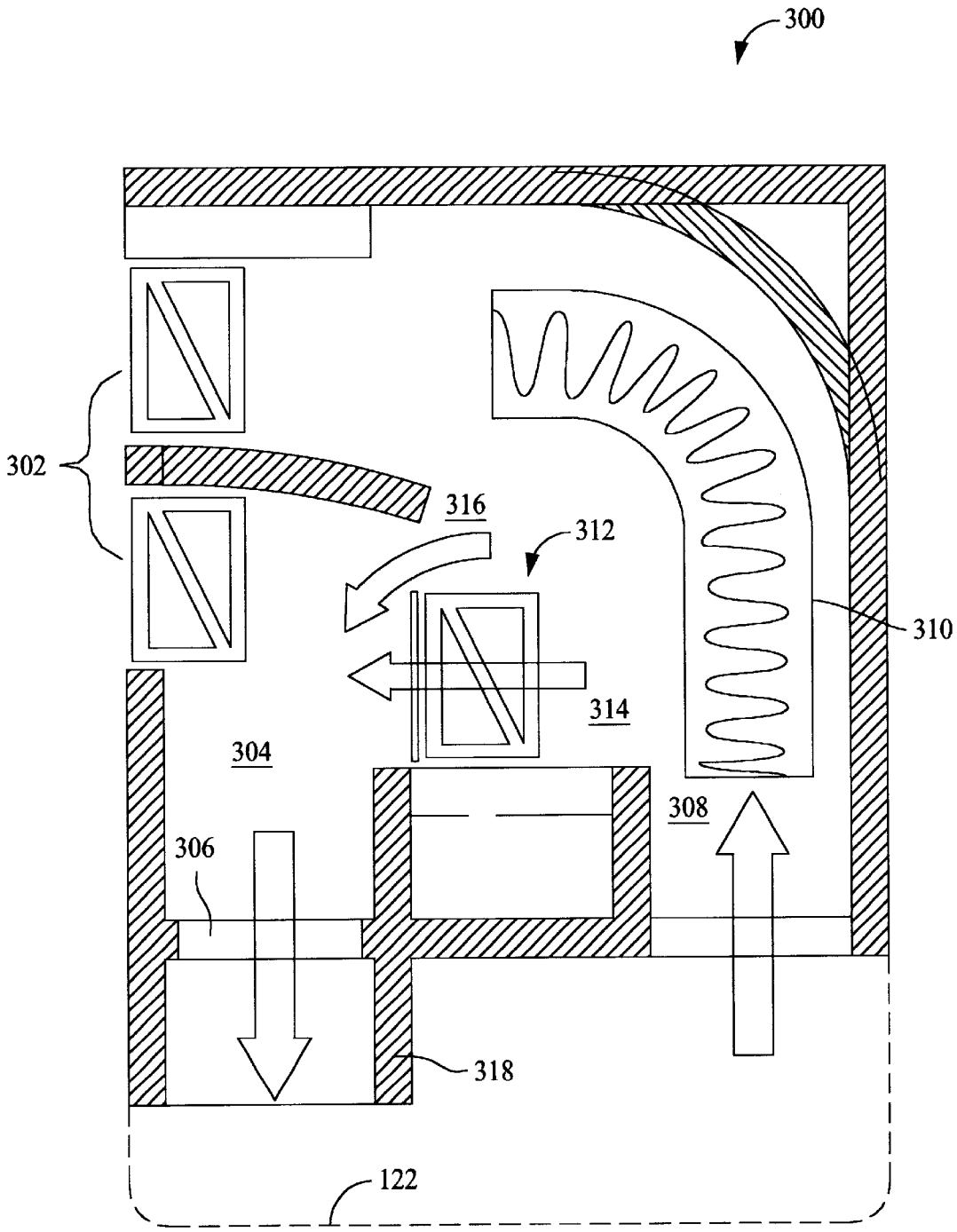
FIG. 7 is a functional schematic of another embodiment of an air handler in a quick thaw mode.

FIG. 7 is a functional schematic of another embodiment of an air handler 300 including a dual damper element 302 in flow communication with freezer compartment 104 air, a supply path 304 including a fan 306, a return path 308 including a heater element 310, a single damper element 312 opening and closing access to a primary re-circulation path 314, and a secondary re-circulation path 316 adjacent single damper element 312. Air is discharged from a side of air handler 300 as opposed to air handler 162 described above including a centered supply path 274 (see FIGS. 4–6), thereby forming a different, and at least somewhat unbalanced, airflow pattern in pan 122 relative to air handler 162 described above. Air handler 300 also includes a plenum extension 318 for improved air distribution within pan 122. Air handler 300 is illustrated in a quick thaw mode, but is operable in a quick chill mode by opening dual damper element 302. Notably, in comparison to air handler 162 (see FIGS. 5 and 6), return path 308 is the source of re-circulation air, as opposed to air handler 162 wherein air is re-circulated from the pan via a re-circulation path 256 separate from return path 254.

Figure 8:
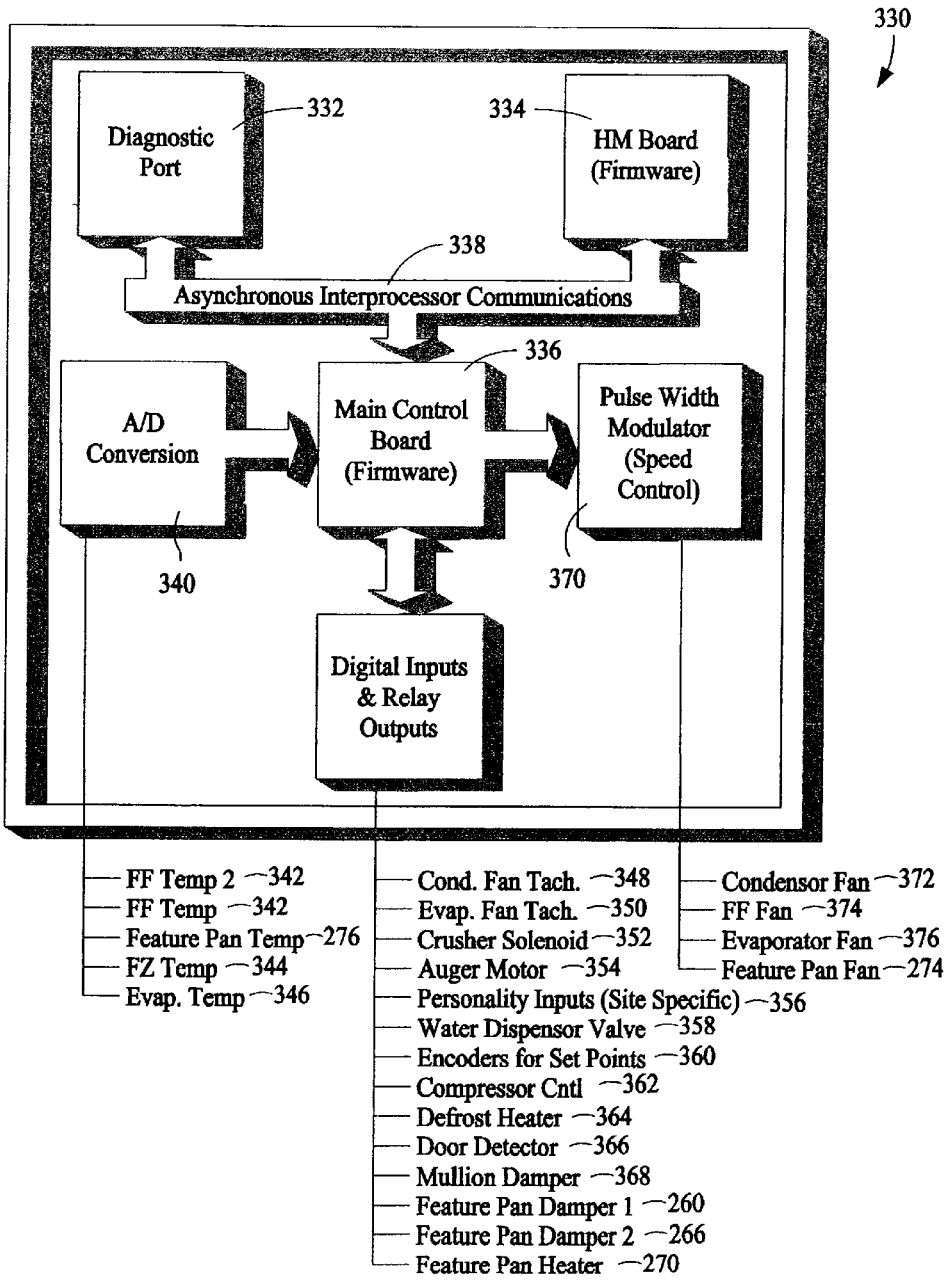
FIG. 8 is a block diagram of a refrigerator controller in accordance with one embodiment of the present invention.

FIG. 8 illustrates a controller 330 in accordance with one embodiment of the present invention. Controller 330 can be used, for example, in refrigerators, freezers and combinations thereof, such as, for example side-by-side refrigerator 100 (shown in FIG. 1). A controller human machine interface (HMI) (not shown in FIG. 8) includes a display (not shown) and one or more input selectors (not shown) for user manipulation to select refrigerator features, including but not limited to quick chill and thaw system features.

Controller 330 includes a diagnostic port 332 and a human machine interface (HMI) board 334 coupled to a main control board 336 by an asynchronous interprocessor communications bus 338. An analog to digital converter ("A/D converter") 340 is coupled to main control board 336. A/D converter 340 converts analog signals from a plurality of sensors including one or more fresh food compartment temperature sensors 342, feature pan (i.e., pan 122 described above in temperature sensors 276 (shown in FIG. 4), freezer temperature sensors 344, external temperature sensors (not shown in FIG. 8), and evaporator temperature sensors 346 into digital signals for processing by main control board 336.

In an alternative embodiment (not shown), A/D converter 340 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pill-down rate of various altitudes by changing fan speed and varying air flow.

Digital input and relay outputs correspond to, but are not limited to, a condenser fan speed 348, an evaporator fan speed 350, a crusher solenoid 352, an auger motor 354, personality inputs 356, a water dispenser valve 358, encoders 360 for set points, a compressor control 362, a defrost heater 364, a door detector 366, a mullion damper 368, feature pan, i.e., quick chill and thaw pan 122, air handler dampers 260, 266 (shown in FIGS. 4–6), and feature pan heater 270 (shown in FIGS. 4–6). Main control board 336 also is coupled to a pulse width modulator 370 for controlling the operating speed of a condenser fan 372, a fresh food compartment fan 374, an evaporator fan 376, and a quick chill system feature pan fan 274 (shown in FIGS. 4–6).

Figure 9A:
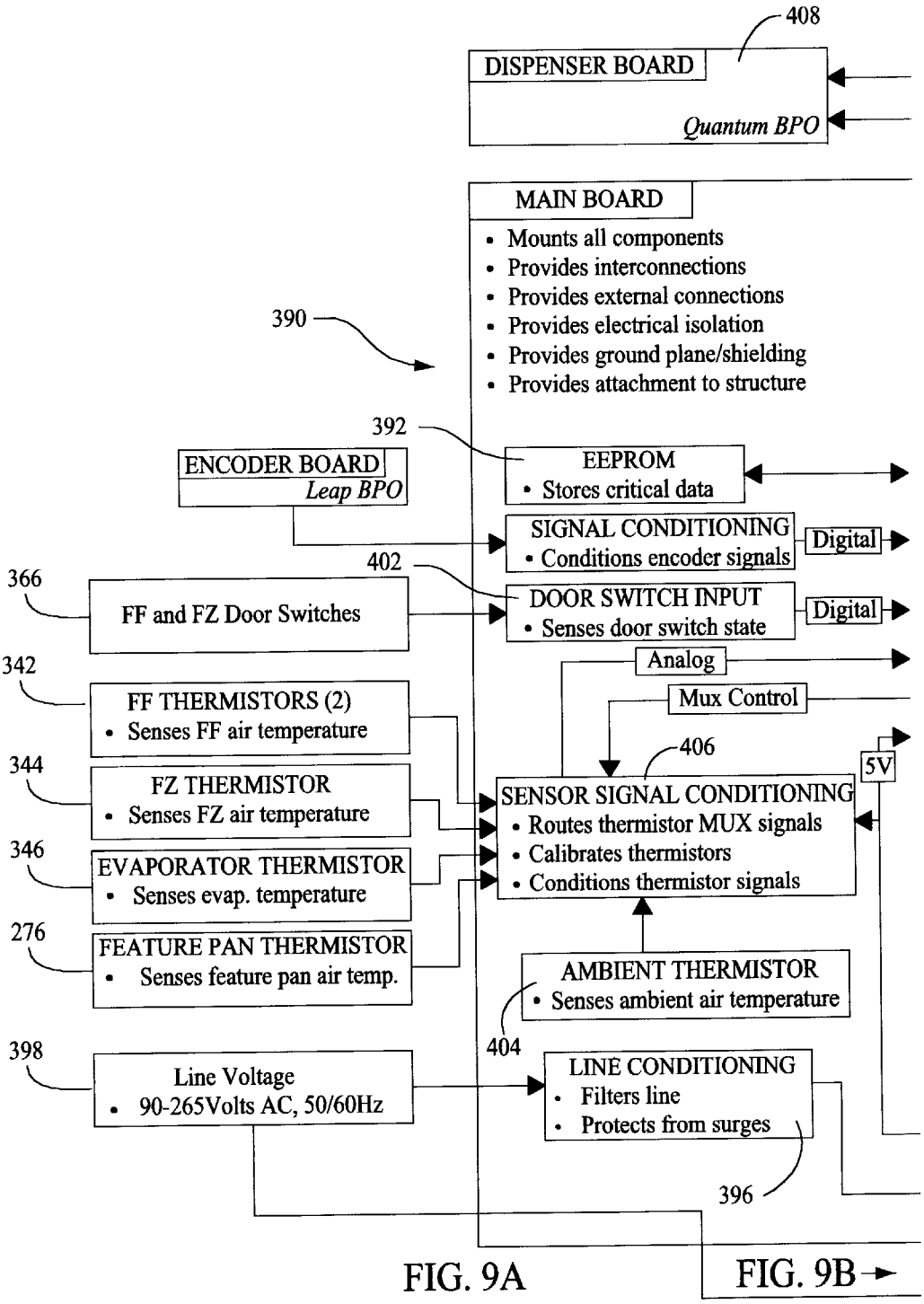
FIG. 9 is a block diagram of the main control board shown in FIG. 8.
Figure 9C:
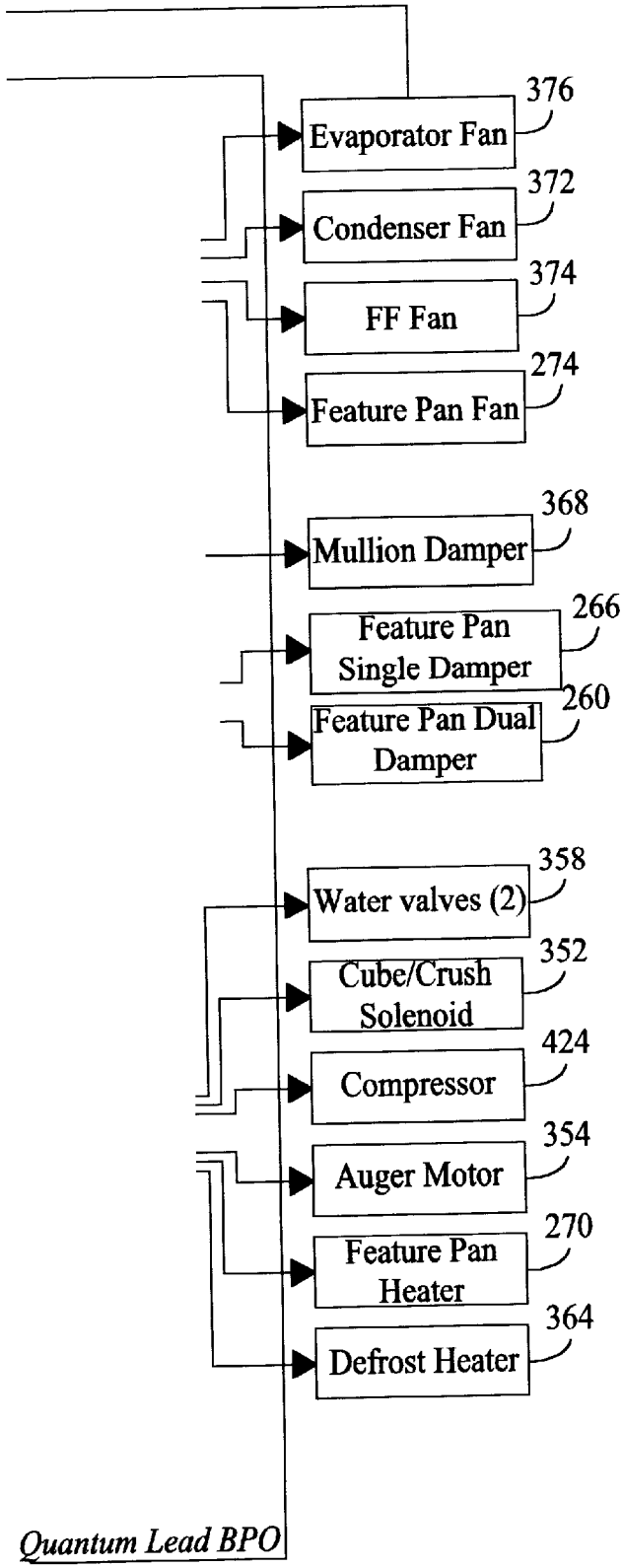

FIG. 9 is a more detailed block diagram of main control board 336. Main control board 336 includes a processor 390. Processor 390 performs temperature adjustments/dispenser communication, AC device control, signal conditioning, microprocessor hardware watchdog, and EEPROM read/write functions. In addition, processor 390 executes many control algorithms including sealed system control, evaporator fan control, defrost control, feature pan control, fresh food fan control, stepper motor damper control, water valve control, auger motor control, cube/crush solenoid control, timer control, and self-test operations.

Processor 390 is coupled to a power supply 394 which receives an AC power signal from a line conditioning unit 396. Line conditioning unit 396 filters a line voltage 398 which is, for example, a 90–265 Volts AC, 50/60 Hz signal. Processor 390 also is coupled to an EEPROM 392 and a clock circuit 400.

Door switch input sensors 402 are coupled to fresh food and freezer door switches 366, and sense a door switch state. A signal is supplied from door switch input sensor 402 to processor 390 in digital form, indicative of the door switch state. Fresh food thermistors 342, a freezer thermistor 344, at least one evaporator thermistor 346, feature pan thermistor 276 (shown in FIG. 4), and an ambient thermistor 404 are coupled to processor 390 via a sensor signal conditioner 406. Conditioner 406 receives a multiplex control signal from processor 390 and provides analog signals to processor 390 representative of the respective sensed temperatures. Processor 390 also is coupled to a dispenser board 408 and a temperature adjustment board 410 via a serial communications link 412. Conditioner 406 also calibrates the above-described thermistors 342, 344, 346, 276, and 404.

Processor 390 provides control outputs to a DC fan motor control 414, a DC stepper motor control 416, a DC motor control 418, and a relay watchdog 420. Watchdog 420 is coupled to an AC device controller 422 that provides power to AC loads, such as to water valves 358, cube/crush solenoid 352, a compressor 424, auger motor 354, feature pan heater 270, and defrost heater 364. DC fan motor control 414 is coupled to evaporator fan 376, condenser fan 372, fresh food fan 374, and feature pan fan 274. DC stepper motor control 418 is coupled to mullion damper 368, and DC motor control 416 is coupled feature pan dampers 260, 266. Functions of the above-described electronic control system are performed under the control of firmware implemented as small independent state machines.

While the following control scheme is set forth in the context of a specific quick chill and thaw system 160 (shown in FIG. 2), it is recognized that the control scheme is adaptable to other configurations of quick chill and thaw systems to produce desired results. Therefore, the following description is for illustrative purposes only and is not intended to limit practice of the present invention to a particular quick chill and thaw system, such as quick chill and thaw system 160.

Figure 10:
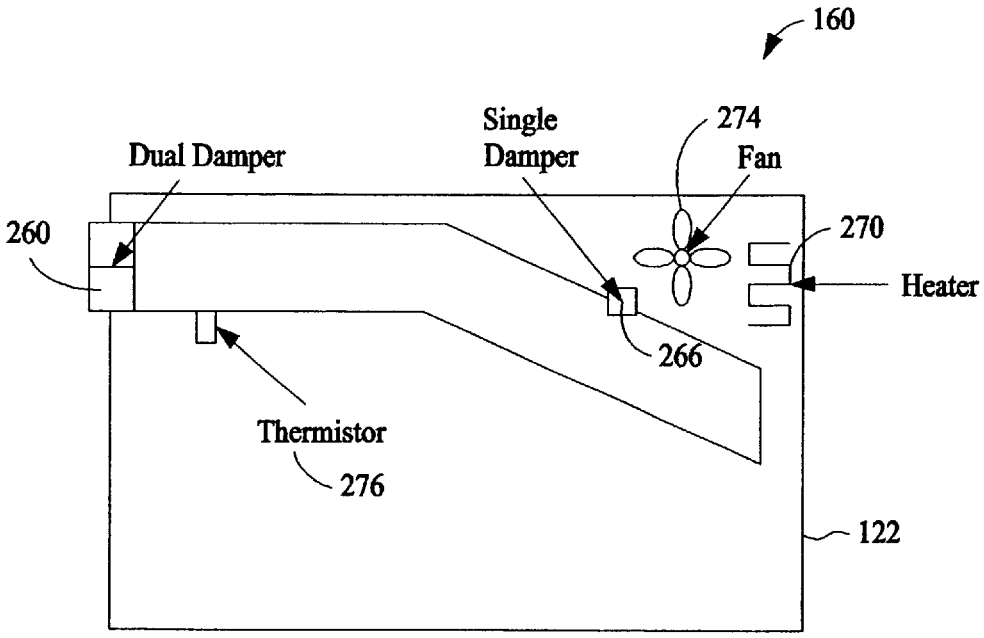
FIG. 10 is a schematic illustration of a quick chill and thaw system.

Referring now to FIG. 10, in an exemplary embodiment quick chill and thaw pan 160 (also shown and described above) includes four primary devices to be controlled, namely air handler dual damper 260, single damper 266, fan 274 and heater 270. Action of these devices is determined by time, a thermistor (temperature) input 276, and user input. From a user perspective, one thaw mode or one chill mode may be selected for pan 122 at any given time. In an exemplary embodiment, three thaw modes are available and three chill modes are selectively available and executable by controller 330 (shown in FIG. 8). In addition, quick chill and thaw pan 122 may be maintained at a selected temperature, or temperature zone, for long term storage of food and beverage item. In other words, quick chill and thaw pan 122, at any given time, may be running in one of several different manners or modes (e.g., Chill 1, Chill 2, Chill 3, Thaw 1, Thaw 2, Thaw 3, Zone 1, Zone 2, Zone 3 or off). Other modes or fewer modes may be available to the user in alternative embodiments with differently configured human machine interface boards 334 (shown in FIG. 8) that determine user options in selecting quick chill and thaw features.

As noted above with respect to FIG. 5, in the chill mode, air handler dual damper 260 is open, single damper 266 is closed, heater 270 is turned off, and fan 274 (shown in FIGS. 4–6) is on. When a quick chill function is activated, this configuration is sustained for a predetermined period of time determined by user selection of a chill setting, e.g., Chill 1, Chill 2, or Chill 3. Each chill setting operates air handler for a different time period for varied chilling performance.

In temperature zone mode, dampers 260, 266 and heater 270 are dynamically adjusted to hold pan 122 at a fixed temperature that is different the fresh food compartment 102 or freezer compartment 104 setpoints.

In thaw mode, as explained above with respect to FIG. 6, dual damper 260 is closed, single damper 266 is opened, fan 274 is turned on, and heater 270 is controlled to a specific temperature using thermistor 276 (shown in FIG. 4) as a feedback component. This topology allows different heating profiles to be applied to different package sizes to be thawed. The Thaw 1, Thaw 2, or Thaw 3 user setting determines the package size selection.

Heater 270 is controlled by a solid state relay located off of main control board 336 (shown in FIGS. 8 and 9). Dampers 260, 266 are reversible DC motors controlled directly by main board 336. Thermistor 276 is a temperature measurement device read by main control board 336. Fan 274 is a low wattage DC fan controlled directly by main control board 336.

While the chill function is a timing function, the thaw function is more complex. In order to safely thaw packages of various sizes a heating profile should be attained to determine the amount of heat to be generated for a given amount of time in order to properly thaw a given package of a certain size, and consequently the heating profile varies from one package size to another.

Figure 11:
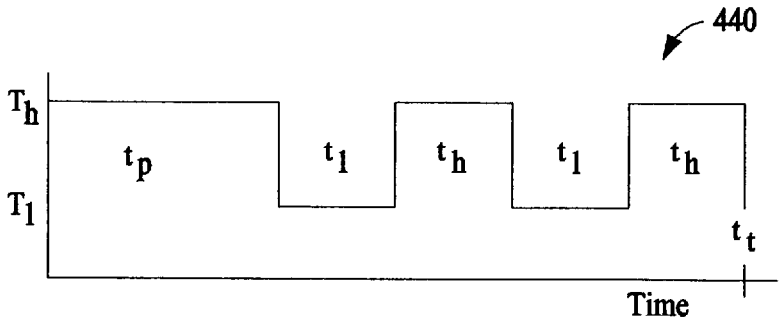
FIGS. 11, 12 and 13 are heating profiles for the quick chill and thaw system shown in FIG. 10.
Figure 12:
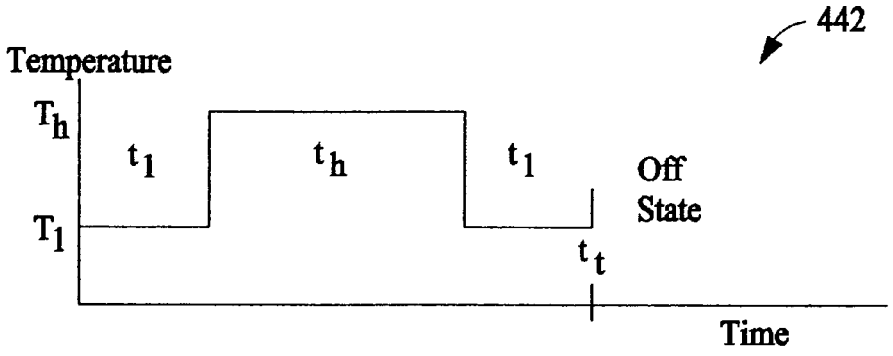
Figure 13:
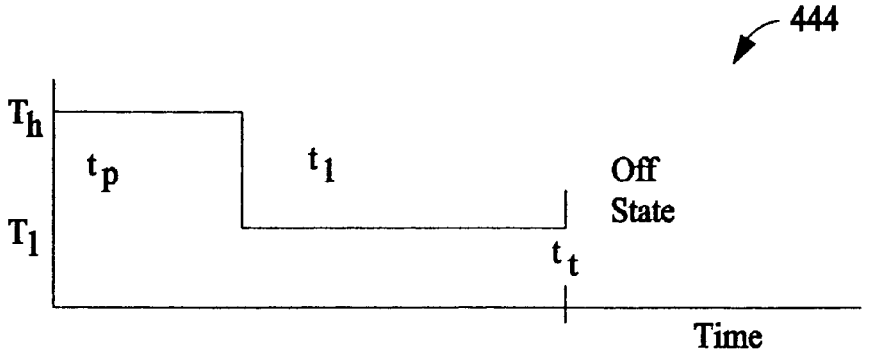

FIGS. 11, 12, and 13 set forth exemplary heating profiles 440, 442, 444, respectively for use in exemplary thaw modes of quick chill and thaw pan 122. Selecting the appropriate values for each time and temperature variable attains the specific profile for a given package. More specifically, heating profile variables include a high temperature ("$T_h$") and a low temperature ("$T_l$") in an exemplary embodiment are set to 45° F. and 40° F., respectively. Time variables include preheat time ("$T_p$") a low temperature time ("$t_l$"), a high temperature time ("$t_h$"), and a total time ("$t_t$") that terminates the cycle. In one embodiment, $t_p$ is set to three hours, $t_l$ is set to one hour, and $t_h$ is set to two hours. Preheat always occurs at the high temperature. As can be seen from FIGS. 11–13, in each heating profile, air handler is adjusted to produce a temperature $T_h$ in pan 122 and maintained at temperature $T_h$ for time $t_h$, and air handler is then adjusted for producing temperature $T_l$ in pan 122 and maintained at temperature $T_l$ for time $t_l$. Heating profile 440 (shown in FIG. 11) includes a preheat cycle wherein the air handler is adjusted to produce a temperature $T_h$ in pan 122 and maintain temperature $T_h$ for time $t_p$.

Heating profiles 440, 442, and 444 are stored in system memory 392 (shown in FIG. 9) and processor 390 (shown in FIG. 9) retrieves the appropriate heating profile in response to user selection of a particular thaw mode. In alternative embodiments, other heating profiles are employed having greater and lesser time and temperature variable values.

Figure 14:
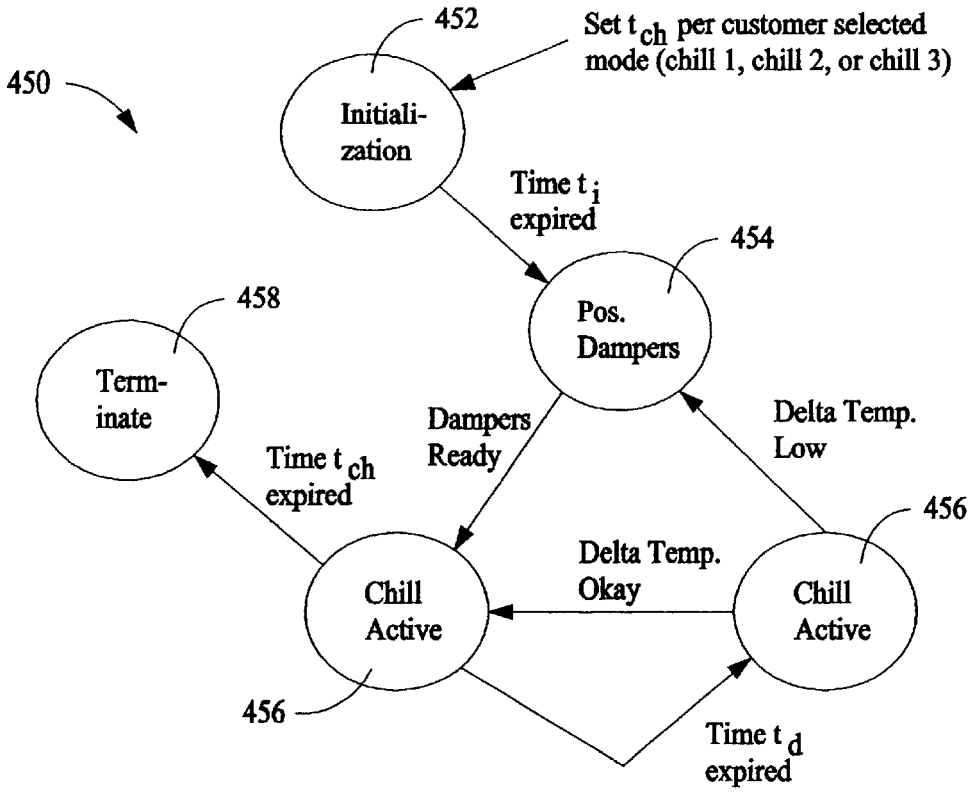
FIG. 14 is a chill state diagram for the quick chill and thaw system shown in FIG. 10.

Referring to FIG. 14, a chill state diagram 450 is illustrated for quick chill and thaw system 160 (shown in FIGS. 2–6). After a user selects an available chill mode, e.g., Chill 1, Chill 2, or Chill 3, a quick chill mode is implemented so that air handler fan 274 shown in FIGS. 4–6) is turned on. Fan 274 is wired in parallel with an interface LED (not shown) that is activated when a quick chill mode is selected to visually display activation of quick chill mode. Once a chill mode is selected, an Initialization state 452 is entered, where heater 270 (shown in FIGS. 4–6) is turned off (assuming heater 270 was activated) and fan 274 is turned on for an initialization time $t_i$ that in an exemplary embodiment is approximately one minute.

Once initialization time $t_i$ has expired, a Position Damper state 454 is entered. Specifically, in the Position Damper state 454, fan 274 is turned off, dual damper 260 is opened, and single damper 266 is closed. Fan 274 is turned off while positioning dampers 260 and 266 for power management, and fan 274 is turned on when dampers 260, 266 are in position.

Once dampers 260 and 266 are positioned, a Chill Active state 456 is entered and quick chill mode is maintained until a chill time ("$t_{ch}$") expires. The particular time value of $t_{ch}$ is dependent on the chill mode selected by the user.

When Chill Active state 456 is entered, another timer is set for a delta time ("$t_d$") that is less than the chill time $t_{ch}$. When time $t_d$ expires, air handler thermistors 276 (shown in FIG. 4) are read to determine a temperature difference between air handler re-circulation path 256 and return path 254. If the temperature difference is unacceptably high or low, the Position Dampers state 454 is re-entered to change or adjust air handler dampers 260, 266 and consequently airflow in pan 122 to bring the temperature difference to an acceptable value. If the temperature difference is acceptable, Chill Active state 456 is maintained.

After time $t_{ch}$ expires, operation advances to a Terminate state 458. In the Terminate state, both dampers 260 and 266 are closed, fan 274 is turned off, and further operation is suspended.

Figure 15:
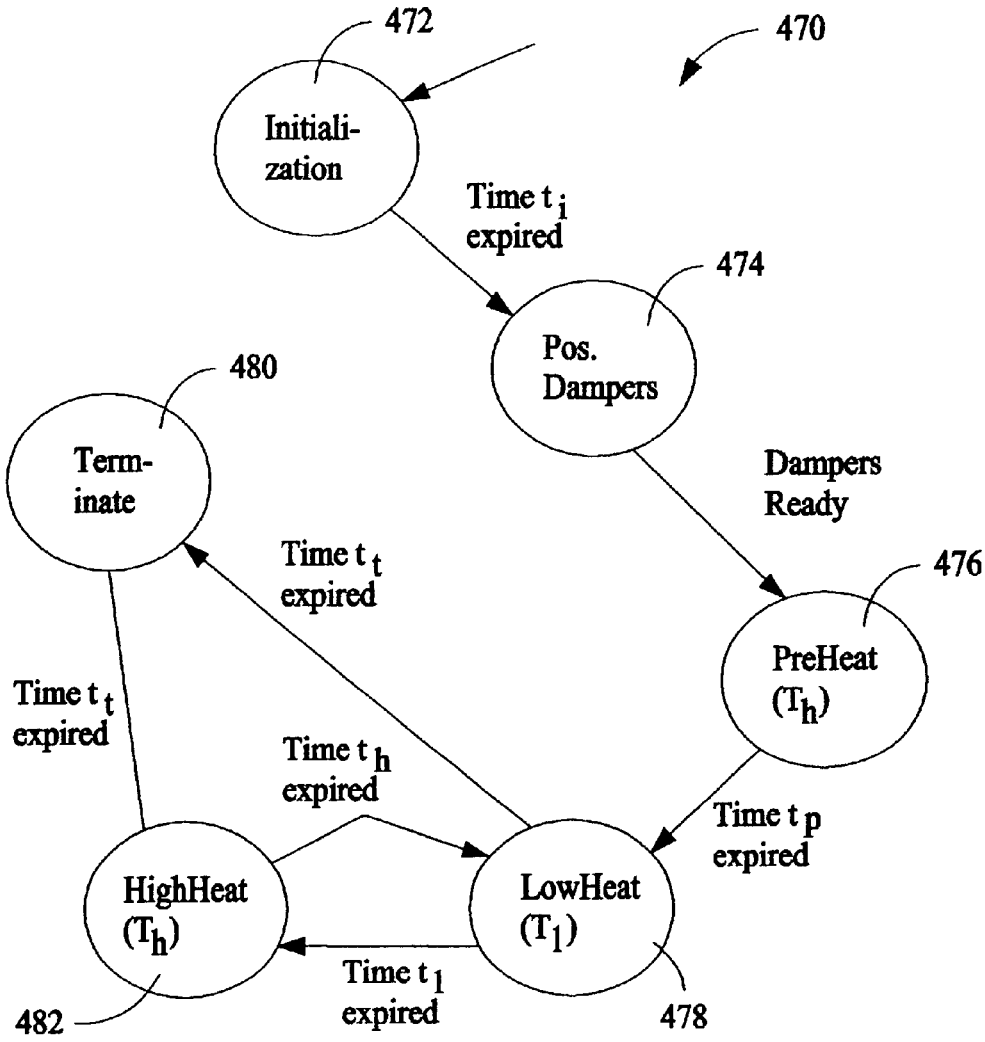
FIG. 15 is a thaw state diagram for the quick chill and thaw system shown in FIG. 10.

Referring to FIG. 15, a thaw state diagram 470 for quick chill and thaw system 160 is illustrated. Specifically, in an initialization state 472, heater 270 shuts off, and fan 274 turns on for an initialization time $t_i$ that in an exemplary embodiment is approximately one minute. Thaw mode is activated so that fan 274 is turned on when a thaw mode is selected. Fan 274 is wired in parallel with an interface LED (not shown) that is activated when a thaw mode is selected by a user to visually display activation of quick chill mode.

Once initialization time $t_i$ has expired, a Position Dampers state 474 is entered. In the Position Dampers state 474, fan 274 is shut off, single damper 266 is set to open, and dual damper 260 is closed. Fan 274 is turned off while positioning dampers 260 and 266 for power management, and fan 274 is turned on once dampers are positioned.

When dampers 260 and 266 are positioned, operation proceeds to a Pre-Heat state 476. The Pre-Heat state 476 regulates the thaw pan temperature at temperature $T_h$ for a predetermined time $t_p$. When preheat is not required, $t_p$ may be set to zero. After time $t_p$ expires, operation enters a LowHeat state 478. From LowHeat state 478, operation is directed to a Terminate state 480 when a total time $t_t$ has expired, or a HighHeat state 482 when a low temperature time $t_l$ has expired (as determined by an appropriate heating profile, such as those described above in relations to FIGS. 11–13). When in the HighHeat state 482, operation will return to the LowHeat state 478 when a high temperature time $t_h$ expires, (as determined by an appropriate heating profile). From the HighHeat state 482, the Terminate state 480 is entered when time $t_l$ expires. In the Terminate state 480, both dampers 260, 266 are closed, fan 274 is shut off, and further operation is suspended.

Figure 16:
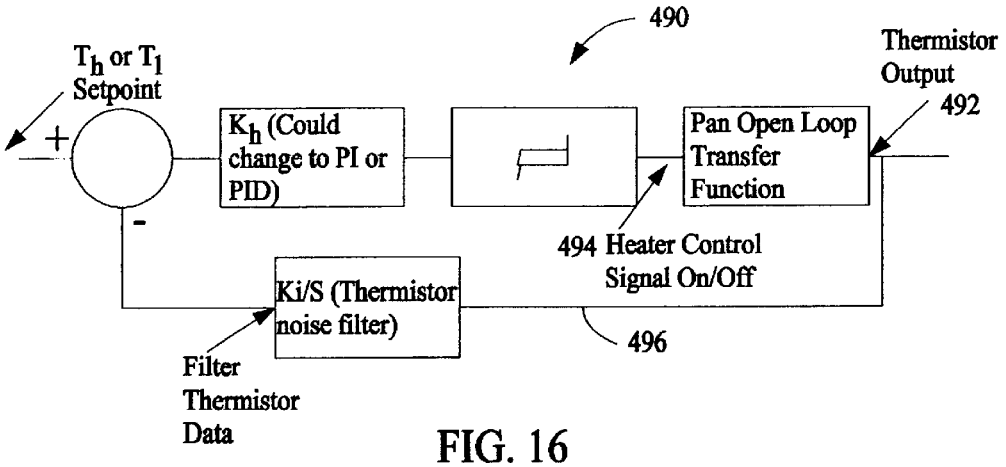
FIG. 16 is a heater control algorithm flowchart for the quick chill and thaw system shown in FIG. 10.

Referring to FIG. 16, a flow chart for a heater control algorithm 490 is illustrated. An output 492 of heater control algorithm 490 is a temperature and its input is the heater ON control signal 494. A small amount of integration in a feedback loop 496 facilitates noise reduction in thermistor input 494. Damper algorithm 450 includes re-tries if the temperature slope is going the wrong direction from the expected slope based on the last damper command.

Figure 17:
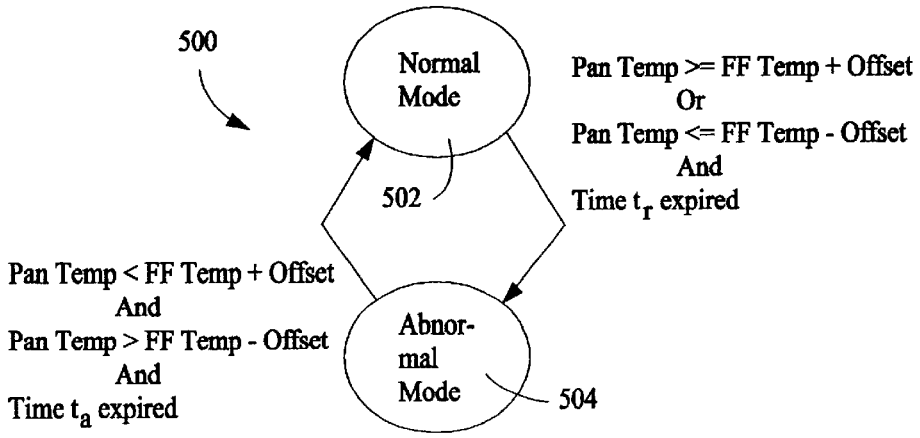
FIG. 17 is an off state diagram for the quick chill and thaw system shown in FIG. 10.

Referring to FIG. 17, an off state diagram 500 is illustrated. In a normal mode 502, dual damper 260 (shown in FIGS. 4–6) is closed, single damper 260 (shown in FIGS. 4–6) is closed, fan 274 (shown in FIGS. 4–6) is off, and heater 270 (shown in FIGS. 4–6) is off. If temperature in pan 122 exceeds a predetermined value of fresh food compartment temperature plus a predetermined offset, then an abnormal mode 504 is entered. In abnormal mode 504, dual damper 260 is open, single damper 266 is closed, fan 274 is on, and heater 270 is turned off. Once the pan temperature is less than a predetermined "normal" temperature operation returns from abnormal 504 to normal mode 500.

Abnormal mode 504 is also entered if temperature of pan 122 is determined to be less than fresh food compartment temperature minus a predetermined offset for a predetermined time $t_r$. In this case, dual damper 260 is closed, single damper 266 is open, fan 274 is turned on, and heater 270 is turned off. When a predetermined time $t_a$ has expired and when pan temperature is greater than fresh food temperature minus the offset, normal mode 502 is re-entered from abnormal mode 504.

Figure 18:
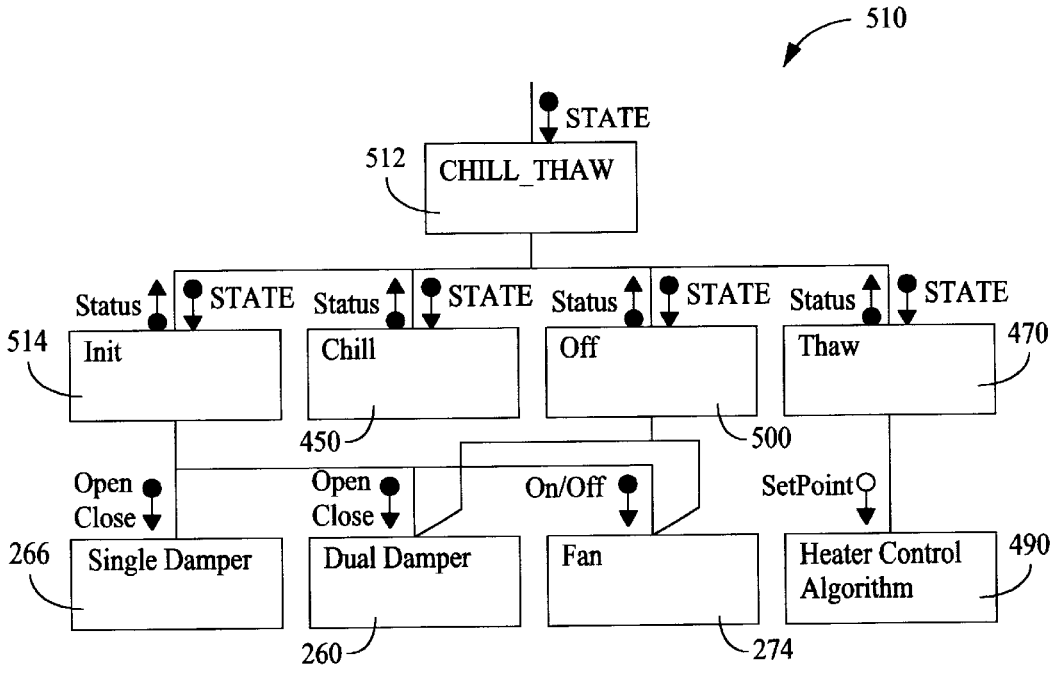
FIG. 18 is a state diagram for the quick chill and thaw system shown in FIG. 10.

FIG. 18 is a state diagram 510 illustrating interrelationships between each of the above described modes. Specifically, once in a CHILL_THAW state 512, i.e., when either a chill or thaw mode is entered for quick chill and thaw system 160, then one of an Initialization state 514, Chill state 450 (also shown in FIG. 14), Off state 500 (also shown in FIG. 17), and Thaw state 470 may be entered. In each state, single damper 260 (shown in FIGS. 4–6), dual damper 266 (shown in FIGS. 4–6), and fan 274 (shown in FIGS. 4–6) are controlled. Heater control algorithm 490 (shown in FIG. 16) can be executed from thaw state 470.

As explained below, sensing a thawed state of a frozen package in pan 122, such as meat or other food item that is composed primarily of water, is possible without regard to temperature information about the package or the physical properties of the package. Specifically, by sensing the air outlet temperature using sensor 276 (shown in FIGS. 4–6 and 10) located in air handler re-circulation air path 256 (shown in FIGS. 4–6), and by monitoring heater 270 on time to maintain a constant air temperature, a state of the thawed item may be determined. An optional additional sensor located in fresh food compartment 102 (shown in FIG. 1), such as sensor 342 (shown in FIGS. 8 and 9) enhances thawed state detection.

An amount of heat required by quick chill and thaw system 160 (shown in FIGS. 2–6) in a thaw mode is determined primarily by two components, namely, an amount of heat required to thaw the frozen package and an amount of heat that is lost to refrigerator compartment 102 (shown in FIG. 1) through the walls of pan 122. Specifically, the amount of heat that is required in a thaw mode may be determined by the following relationship:

$$Q=h_a(t_{air}-t_{surface})+A/R(t_{air}-t_{ff}) \quad (1)$$

where $h_a$ is a heater constant, $t_{surface}$ is a surface temperature of the thawing package, $t_{air}$ is the temperature of circulated air in pan 122, $t_{ff}$ is a fresh food compartment temperature, and A/R is an empirically determined empty pan heat loss constant. Package surface temperature $t_{surface}$ will rise rapidly until the package reaches the melting point, and then remains at a relatively constant temperature until all the ice is melted. After all the ice is melted. $t_{surface}$ rapidly rises again.

Assuming that $t_{ff}$ is constant, and because air handler 162 is configured to produce a constant temperature airstream in pan 122, $t_{surface}$ is the only temperature that is changing in Equation (1). By monitoring the amount of heat input Q into pan 122 to keep $t_{air}$ constant, changes in $t_{surface}$ may therefore be determined.

If heater 270 duty cycle is long compared to a reference duty cycle to maintain a constant temperature of pan 122 with an empty pan, $t_{surface}$ is being raised to the package melting point. Because the conductivity of water is much greater than the heat transfer coefficient to the air, the package surface will remain relatively constant as heat is transferred to the core to complete the melting process. Thus, when the heater duty cycle is relatively constant, $t_{surface}$ is relatively constant and the package is thawing. When the package is thawed, the heater duty cycle will shorten over time and approach the steady state load required by the empty pan, thereby triggering an end of the thaw cycle, at which time heater 270 is de-energized, and pan 122 returns to a temperature of fresh food temperature 102 (shown in FIG. 1).

In a further embodiment, $t_{ff}$ is also monitored for more accurate sensing of a thawed state. If $t_{ff}$ is known, it can be used to determine a steady state heater duty cycle required if pan 122 were empty, provided that an empty pan constant A/R is also known. When an actual heater duty cycle approaches the reference steady state duty cycle if the pan were empty, the package is thawed and thaw mode may be ended.

While the invention has been described in terms of various specific embodiments, those skilled in the art will recognize that the invention can be practiced with modification within the spirit and scope of the claims.

What is claimed is:

1. A method for controlling a quick chill and thaw system for a refrigerator, the refrigerator including a fresh food compartment and a freezer compartment, the quick chill and thaw system including a pan and an air handler in flow communication with both of the fresh food and freezer compartments, the refrigerator further including an electronic controller coupled to the air handler, said method comprising the steps of:

adjusting the air handler to produce a constant temperature airstream in the pan, wherein the air handler comprises a first and a second damper;

maintaining a first constant air temperature in the pan to execute a chill mode when selected by a user; and maintaining a second constant air temperature in the pan to execute a thaw mode when selected by a user.

2. A method in accordance with claim 1 wherein said step of maintaining a constant air temperature in the pan to execute a thaw mode comprises the steps of:

maintaining a first constant temperature for at least a first predetermined period of time; and maintaining a second constant temperature different from the first constant temperature for at least a second predetermined period of time.

3. A method in accordance with claim 2 further comprising the step of cycling the air handler between the first constant temperature and the second constant temperature according to a heating profile.

4. A method in accordance with claim 1, the air handler including a heater, said step of maintaining a constant air temperature in the pan to execute a thaw mode comprises the steps of:

monitoring a heat output of the heater; and comparing the heat output to a predetermined heat output to determine an end of the thaw mode.

5. A method in accordance with claim 4 wherein said step of monitoring a heat output of the heater comprises the step of monitoring a duty cycle of the heater.

6. A method in accordance with claim 1 wherein the air handler includes at least an air supply path and an air return path, the first damper for establishing flow communication with supply air, the second damper for establishing flow communication between the supply path and the return path; said step of adjusting the air handler to produce a constant temperature airstream comprising the steps of positioning the first and second dampers to adjust airflow through the air handler.

7. A method in accordance with claim 6 wherein said step of positioning the first and second dampers comprises opening the first damper and closing the second damper when a chill mode is selected.

8. A method in accordance with claim 7 wherein the air handler further includes a fan located in the supply path, said step of adjusting the air handler to produce a constant temperature airstream further comprising step of energizing the fan when a chill mode is selected.

9. A method in accordance with claim 6 wherein said step of positioning the first and second dampers comprises closing the first damper and opening the second damper when a thaw mode is selected.

10. A method in accordance with claim 9 wherein the air handler includes a heater, said step of adjusting the air handler to produce a constant temperature airstream further comprising step of energizing the heater when a thaw mode is selected.

11. A method in accordance with claim 1 wherein said step of maintaining a constant air temperature in the pan to execute a chill mode comprises the step of maintaining a predetermined air temperature in the pan for a predetermined period of time when a chill mode is selected.

12. A method in accordance with claim 11 wherein the air handler includes a return path and a re-circulation path, a first temperature sensor located in the return path and a second temperature sensor located in the re-circulation path, said step of maintaining a constant air temperature in the pan further comprising the steps of:

determining a temperature differential between the first and second temperature sensors; and re-adjusting the air handler if the determined temperature difference is unacceptable.

13. A control system for a refrigerator including a quick chill and thaw system, the quick chill and thaw system including an air handler and a pan, the air handler operable in at least one chill mode and at least one thaw mode, said control system comprising:

an electronic controller coupled to the air handler; said controller configured to:

position a first and a second damper to adjust airflow through the air handler;

adjust the air handler to produce a constant temperature airstream in the pan;

maintain a first constant temperature airstream in the pan to execute a chill mode when selected by a user; and maintain a second constant temperature airstream in the pan to execute a thaw mode when selected by a user.

14. A control system in accordance with claim 13 said controller further configured to:

operate the air handler to maintain a first constant temperature for at least a first predetermined period of time; and operate the air handler to maintain a second constant temperature different from the first constant temperature for at least a second predetermined period of time when executing the thaw mode.

15. A control system in accordance with claim 14, said controller comprising a processor and a memory, said processor configured to cycle the air handler between the first constant temperature and the second constant temperature according to a heating profile stored in system memory.

16. A control system in accordance with claim 13, the air handler including a heater, said controller further configured to:

energize the heater for at least a first predetermined time when the thaw mode is selected;

monitor a heat output of the heater; and compare the heat output to a predetermined heat output to determine an end of the thaw mode.

17. A control system in accordance with claim 16, said controller configured to monitor a duty cycle of the heater.

18. A control system in accordance with claim 13 wherein the air handler includes at least an air supply path and an air return path, said first damper for establishing flow communication with supply air, said second damper for establishing flow communication between the supply path and the return path.

19. A control system in accordance with claim 18, said controller configured to open the first damper and close the second damper when the chill mode is selected.

20. A control system in accordance with claim 19 wherein the air handler further includes a fan located in the supply path, said controller configured to energize the fan when the chill mode is selected.

21. A control system in accordance with claim 18 said controller configured to close the first damper and open the second damper when a thaw mode is selected.

22. A control system in accordance with claim 21 wherein the air handler includes a heater, said controller configured to energize the heater when the thaw mode is selected.

23. A control system in accordance with claim 13 wherein said controller is configured to maintain a predetermined air temperature in the pan for a predetermined period of time when the chill mode is selected.

24. A control system in accordance with claim 23 wherein the air handler includes a return path and a re-circulation path, a first temperature sensor located in the return path and a second temperature sensor located in the re-circulation path, said controller configure to:

determine a temperature differential between the first and second temperature sensors; and re-adjust the air handler if the determined temperature difference is unacceptable.

* * * * *